US006817802B2

(12) United States Patent
Nishitani et al.

(10) Patent No.: US 6,817,802 B2
(45) Date of Patent: Nov. 16, 2004

(54) WRITING INSTRUMENT

(75) Inventors: Ichiro Nishitani, Yamatokoriyama (JP); Akira Matsuda, Osaka (JP); Masatoshi Yashima, Nara (JP)

(73) Assignee: Kuretake Co., Ltd., Nara (JP)

( * ) Notice: Subject to any disclaimer, the term of this patent is extended or adjusted under 35 U.S.C. 154(b) by 0 days.

(21) Appl. No.: 10/464,119

(22) Filed: Jun. 18, 2003

(65) Prior Publication Data

US 2004/0028464 A1 Feb. 12, 2004

(30) Foreign Application Priority Data

Jun. 19, 2002 (JP) ..... 2002-178290

(51) Int. Cl.[7] ..... B43K 5/18; B43K 5/00
(52) U.S. Cl. ..... 401/235; 401/205; 401/206
(58) Field of Search ..... 401/199, 205, 401/206, 214, 219, 232, 235

(56) References Cited

U.S. PATENT DOCUMENTS

| | | | | |
|---|---|---|---|---|
| 2,637,466 A | * | 5/1953 | Wright | 222/80 |
| 3,468,611 A | * | 9/1969 | Ward | 401/186 |
| 5,035,524 A | | 7/1991 | Sakurai | |
| 5,362,168 A | | 11/1994 | Abe et al. | |
| 5,967,688 A | * | 10/1999 | Hu | 401/206 |
| 6,406,205 B1 | | 6/2002 | Hu | |

FOREIGN PATENT DOCUMENTS

| | | |
|---|---|---|
| GB | 2177295 | 1/1987 |
| JP | 57-198769 | * 12/1982 |

* cited by examiner

*Primary Examiner*—David J. Walczak
(74) *Attorney, Agent, or Firm*—Anthony J. Casella; Gerald E. Hespos

(57) ABSTRACT

A writing instrument adapted, responsive to a pressure axially applied to a pen core, to supply ink in an ink chamber to the pen core, and includes a valve seat disposed between the ink chamber and the pen core, a valve body operable to be selectively moved between a close position where the valve body is in contact with the valve seat to isolate the pen core from the ink chamber and an open position where the valve body is spaced apart from the valve seat to communicate the pen core with the ink chamber, a pressing spring for biasing the valve body toward the front end of a pen shaft, and a support member for supporting the valve body and the pressing spring to allow the valve body to be moved in the axial direction. The support member includes a communication channel for communicating the inner space thereof with the ink chamber. The valve body has a channel control portion for allowing the ink flow through the communication channel to be more restricted when the valve body is in the close position that when it is in the open position. The writing instrument can reduce the deposit of ink pigments around the valve body to prevent occurrence of defect in the operation of the valve body.

18 Claims, 7 Drawing Sheets

WRITING INSTRUMENT

FIELD OF THE INVENTION

This invention relates to a writing instrument adapted, responsive to a pressure applied to a pen core, to supply ink stored in an ink chamber inside a pen shaft to the pen core.

BACKGROUND OF THE INVENTION

There has heretofore been known a writing instrument adapted, responsive to a pressure applied to a pen core, to supply ink stored in an ink chamber inside a pen shaft to the pen core. One example of such a writing instrument is shown in FIG. 13. A writing instrument 100 comprises a valve body 60 operable, responsive to a pressure applied to a pen core 5 and the release of the pressure, to be moved in the axial direction of a pen shaft 3, wherein the valve body 60 opens and closes an ink supply passage 10 leading to the pen core 5, so as to controllably supply ink from an ink chamber 2 to the pen core 5. More specifically, the valve body 60 is supported in an axially movable manner by a support member 7 disposed to surround the ink supply passage 10 leading to the pen core 5, while receiving a biasing force toward the front end of the pen shaft 3 from a pressing spring 8 which is also supported by the support member 7, whereby in response to the movement of the valve body 60 in a direction getting close to or away from a valve seat 91 (the inner wall of the ink supply passage 10), a tapered portion 60*a* of the valve body 60 is brought into contact with or released from the valve seat 91 to close or open the ink supply passage 10. In this writing instrument 100, the ink in the ink chamber 2 enters from the ink chamber 2 into the inner space of the support member 7 through a communication channel 11 formed in the support member 7. Then, when the tapered portion 60*a* of the valve body 60 is released from the valve seat 91, the resultingly opened ink supply passage 10 allows the ink in the support member 7 to be supplied to the pen core 5.

As shown in FIG. 14, in the above writing instrument 100, the communication channel 11 leading from the ink chamber 2 to the inner space of the support member 7 is configured to consistently maintain the communication therebetween independently of the operation of the valve body 60 for opening or closing the ink supply passage 10, so that the ink in the ink chamber 2 is allowed to enter and reside in the inner space of the support member 7. Thus, pigments and others contained in the ink are liable to be deposited in the inner space of the support member 7, and the deposited pigments can cause the risk of disturbing a proper movement of the valve body 60 due to their clogging between the windings of the pressing spring 8 or the like. Particularly when an ink with a high content of pigment is used, this phenomenon becomes obvious. While the ink stored in the ink chamber 2 can be stirred through a technique of containing a stirring weight in the ink chamber 2 and shaking the writing instrument 100 to move the stirring weight around the ink chamber 2, such a stirring weight cannot be received in the inner space of the support member 7 because of the design in which the valve body 60 is essentially located therein. Thus, it has been difficult to sufficiently stir the ink in the inner space of the support member 7 so as to eliminate deposits in the inner space of the support member 7.

SUMMARY OF THE INVENTION

It is an object of the present invention to provide a writing instrument which is free from the problem residing in the prior art.

It is another object of the present invention to provide a writing instrument which can reduce the deposit of ink pigments around a valve body for controlling the ink supply to a pen core to minimize occurrence of defect in the operation of the valve body.

According to an aspect of the invention, a writing instrument supplies ink from an ink chamber inside a pen shaft to the pen core through an ink supply passage in response to a pressure axially applied to the pen core. The writing instrument comprises a valve seat disposed between the ink chamber and the pen core, a valve body operable, responsive to a pressure applied to the pen core, a biasing member for biasing the valve body to keep the valve body in the close position, and a support member disposed inside the ink chamber to surround the valve seat and at least a portion of the valve body to be brought into contact with the valve seat.

In the writing instrument, the support member includes a communication channel for communicating the inner space of the support member with the ink chamber, and the valve body has a channel control portion for allowing the ink flow through the communication channel to be more restricted when the valve body is in the close position than when it is in the open position.

Other features and advantages of the present invention will be apparent from the accompanying drawings and from the detailed description.

DESCRIPTION OF THE PREFERRED EMBODIMENTS

Figure 1:
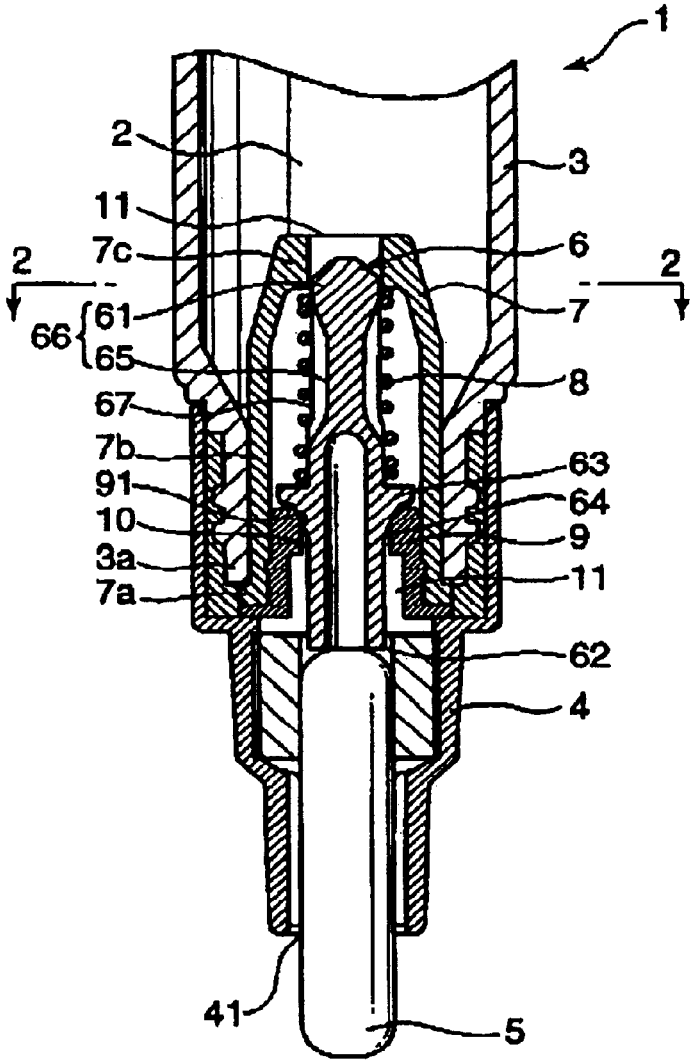
FIG. 1 is a fragmentary sectional view showing a structure around a pen core of a writing instrument according to an embodiment of the present invention, wherein a valve body is located at a position for closing an ink supply passage.
Figure 2:
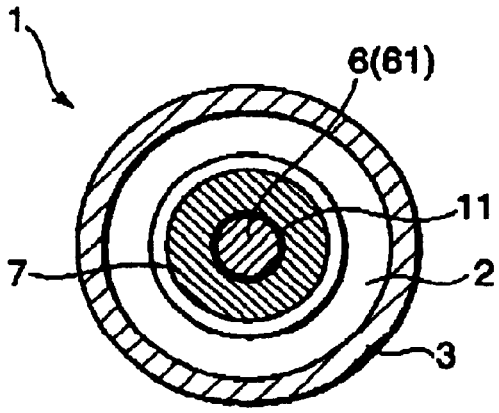
FIG. 2 is a sectional view taken along the line 2—2 in FIG. 1.

With reference to the drawings, a writing instrument according to an embodiment of the present invention will now be described. Referring to FIGS. 1 and 2, a writing instrument 1 comprises a pen shaft 3 formed with an ink chamber 2 thereinside, a front tube 4 attached to the front end of the pen shaft 3, and a pen core 5 attached to the front end of the front tube 4. The pen core 5 is inserted into an aperture 41 formed in the front end of the front tube 4, and supported by the front tube 4 in such manner that it is movable along the inside of the aperture 41 in the axial direction of the pen shaft 3.

The writing instrument 1 further includes a valve body 6 for opening and closing an ink supply passage 10 leading to the pen core 5, and a support member 7 for supporting the valve body 6, in the inner space of the pen shaft 3. The support member 7 is disposed to surround the valve body 6 and the ink supply passage 10. The support member 7 is formed as a cap-shaped body which has an opening at the front end 7*a* thereof fixed to the front end 3*a* of the pen shaft 3, a tubular sidewall 7*b* extending from the front end 7*a* toward the rear end, and a bottom wall 7*c* at the rear end. The bottom wall 7*c* is formed with a communication channel 11 penetrating therethrough to communicate the inner space of the support member 7 with the ink chamber 2. The communication channel 11 is located on the axis of the pen core 5 and the valve body 6, and the support member 7 supports the valve body 6 and an after-mentioned pressing spring 8 to allow the valve body 6 to be moved in the axial direction of the pen shaft.

The writing instrument 1 further includes a valve seat member 9 disposed between the lower portion of the support member 7 and the pen core 5. The valve seat member 9 has a taper-shaped inner peripheral wall defining an aperture on the side of the rear end thereof. The inner peripheral wall serves as a valve seat 91 to be associated with the valve body 6, and the aperture serves as the ink supply passage 10 for supplying ink from the ink chamber 2 to the pen core 5 through the inner space of the support member 7. The valve seat member 9 is fixedly clamped between the pen shaft 3 and the front tube 4, while being fitted into the inner surface of the lower portion of the support member 7

The valve body 6 is formed in a configuration extending in the axial direction of the pen shaft 3. Specifically, the valve body 6 has an after-mentioned channel control portion 66 formed on side of the rear end thereof. The channel control portion 66 is adapted to be inserted into the communication channel 11, and the front end 62 of the valve body on the side of the front end of the pen shaft 3 is formed to penetrate the ink supply passage 10 and contact the pen core 5. The axially intermediate region of the valve body 6 is formed with a rib-shaped cover portion (stirring portion) 63 protruding radially outward from the outer peripheral surface thereof, and a tapered surface 64 defining the outer peripheral surface tapered from the cover portion 63 toward the front end 62. The ink supply passage 10 is closed by bringing the taped surface 64 into contact with the valve seat 91. The cover portion 63 is formed in a configuration which protrudes to a position adjacent to the inner wall of the support member 7 so as to cover the contact region between the valve body 6 and the valve seat 91 when the valve body 6 is in its close position. As the cover portion 63 is moved toward the ink chamber 2 in conjunction with the movement of the valve body 6 from the close position to its open position, the cover portion 63 is operative to push the ink in the inner space of the support member 7 toward the ink chamber 2 while stirring the ink. Simultaneously, a small clearance provided between the cover portion 63 and the inner wall of the support member 7 allows a necessary amount of ink to be supplied to the pen core 5 therethrough.

The pressing spring or biasing member 8 composed of a compression spring is attached between the cover portion 63 of the valve body 6 and the bottom wall 7*c* of the support member 7, and the valve body 6 is urged or biased toward the pen core 5 (toward the front end of the pen shaft 3) all the time by the biasing force of the pressing spring 8. In a normal condition, the pressing spring 8 biasing the valve body 6 allows the valve body 6 to be kept in the close position where the tapered surface 64 of the valve body is in contact with the valve seat 91 or where the valve body 6 closes the ink supply passage 10 to stop any ink supply to the pen core 5. The valve body 6 is slidably moved in the axial direction of the pen shaft 3 while inserting the channel control portion 66 on the side of the rear end of the valve body into the communication channel 11 and inserting the front end 62 into the ink supply passage 10. When the pen core 5 is pushed toward the inside of the pen shaft 3 (toward the rear end of the pen shaft 3) by a pressure applied to the pen core 5, the valve body 6 is concurrently moved against the biasing force of the pressing spring 8 toward the ink chamber 2 to release the tapered surface 64 from the valve seat 91, and finally moved to the open position where the valve body 6 opens the ink supply passage 10.

The channel control portion 66 is formed in a configuration having a cross-sectional shape which is changed in the axial direction. Specifically, the channel control portion 66 comprises a rear head 61 with a large diameter, and a shank 65 with a small diameter which is located on the side of the font end relative to the rear head 61. The shank 65 is formed with a rib-shaped guide 67 protruding radially outward from the outer peripheral surface thereof. The guide 67 is operative to prevent wobbling movements of the valve body 6 in the communication channel 11 so as to assure a clearance between the outer peripheral surface of the shank 65 and the inner peripheral surface of the communication channel 11 while supporting the valve body 6 in a desired posture. As shown in FIG. 2, the rear head 61 is formed to have a slightly smaller diameter than that of the communication channel 11, so as to reduce the ink flow area of the communication channel 11 allowing ink to flow from the ink chamber 2 to the inner space of the support member 7 when the end head 61 is associated with or inserted into the communication channel 11. When the valve body 6 is in the close position, the rear head 61 is operative to reduce the ink flow area and substantially preclude the ink flow, and simultaneously the tapered surface 64 of the valve body 6 is operative to close the ink supply passage 10 leading to the pen core 5.

On the other hand, when the valve body 6 is moved to the open position on the side of the rear end, the shank 65 is associated with or inserted into the communication channel 11 to provide an increased clearance between the inner wall of the communication channel 11 and the valve body 6 and an increased ink flow area, so that the communication channel 11 is opened to allow an increased amount of ink to flow from the ink chamber 2 to the inner space of the support member 7.

Figure 3:
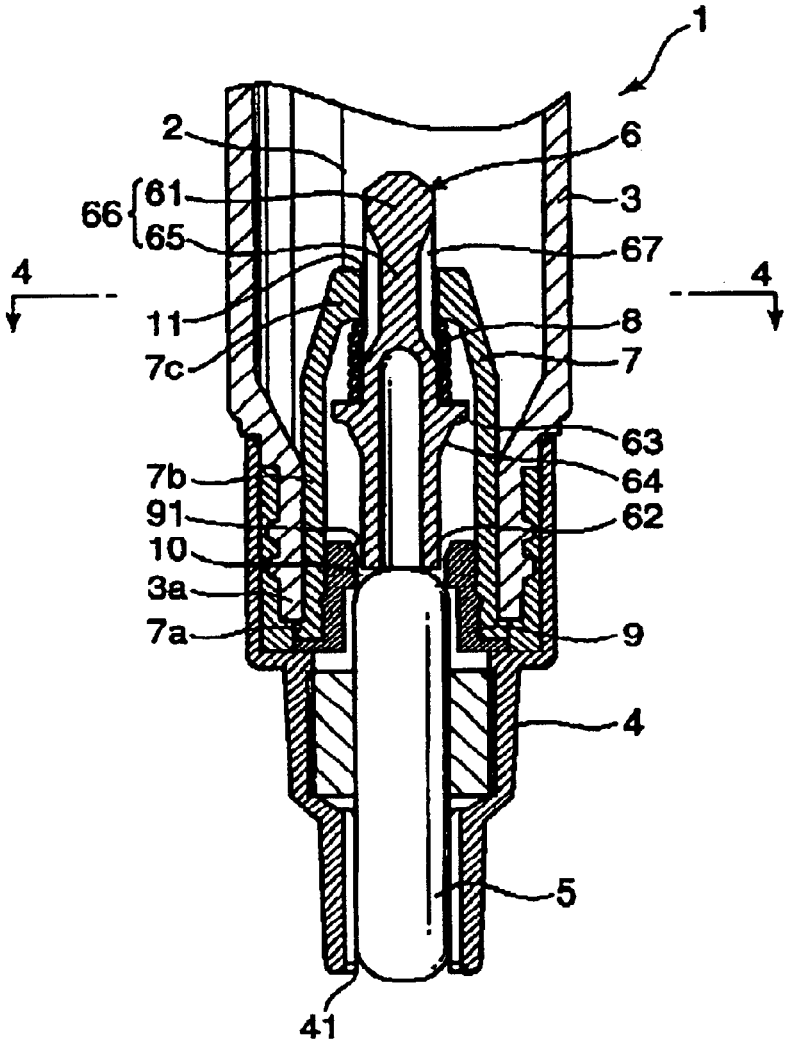
FIG. 3 is a fragmentary sectional view showing the writing instrument in FIG. 1, wherein the valve body is located at a position for opening the ink supply passage.
Figure 4:
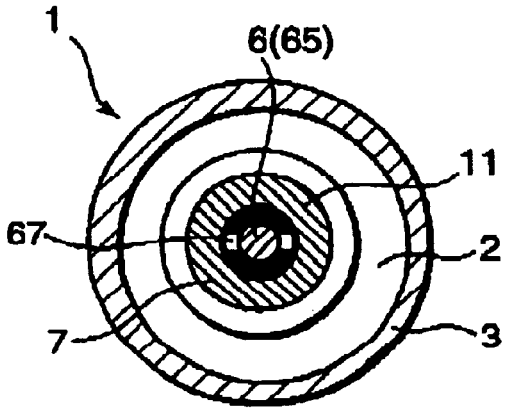
FIG. 4 is a sectional view taken along the line 4—4 in FIG. 3.

The operation of the valve body 6 will be described below in more detail. FIG. 3 is a fragmentary sectional view showing the writing instrument 1, wherein the valve body 6 is located at a position for opening the ink supply passage 10. FIG. 4 is a sectional view taken along the line 4—4 in FIG. 3. As described above, in a normal condition, the valve body 6 is kept in the close position where the tapered surface 64 is in contact with the valve seat 91 under the biasing force of the pressing spring 8 to close the ink supply passage 10 and interrupt the ink supply to the pen core 5. When the pen core 5 is pressed onto the surface of a writing paper or the like and pushed toward the inside of the pen shaft 3, the valve body 6 is moved against the biasing force of the pressing spring 8 toward the rear end (toward the ink chamber 2) in conjunction with the movement of the pen core 5, so that the tapered surface 64 is released from the valve seat 91 to open the ink supply passage 10. Simultaneously, the rear head 61 of the valve body 6 is moved into the inner space of the ink chamber 2. Thus, the shank 65 having a smaller diameter than that of the rear head 61 is associated with or inserted into the communication channel 11, as shown in FIG. 3, to provide an increased clearance between the inner wall of the communication channel 11 and the outer peripheral surface of the valve body 6 and an increased ink flow area (cross-sectional area). As the ink flow area of the communication channel 11 is increased, the communication channel 11 has an increased flow area allowing a great volume of ink to flow from the ink chamber 2 to the inner space of the support member 7. The ink supply passage 10 is simultaneously opened to allow the ink in the inner space of the support member 7 to be supplied to the pen core 5.

When the pressure applied to the pen core 5 is released, the biasing force of the pressing spring 8 gives rise to the movement of the valve body 6 toward the front end of the pen shaft 3, and the valve body 6 presses the pen core 5 to trigger the movement of the pen core 5 toward the front end of the pen shaft 3. Then, the taped surface 64 of the valve body 6 is brought into contact with the inner wall of the ink supply passage 10 again to close the ink supply passage 10, so that the ink supply to the pen core 5 is interrupted. The rear head 61 of the valve body 6 is simultaneously moved to a position where the rear head 61 is associated with the communication channel 11 to restrain the ink flow from the ink chamber 2 to the inner space of the support member 7.

According to the writing instrument 1 constructed as above, when the writing instrument 1 is not used at other times, or the ink supply passage 10 leading to the pen core 5 is closed by the valve body 6, the communication channel 11 is closed by the rear head 61 of the valve body 6. Thus, the ink in the ink chamber 2 seldom flows into the inner space of the support member 7, and any undesirable increase in the amount of ink residing in the inner space of the support member 7 can be avoided. Thus, even if the pigments of ink are deposited in the inner space of the support member 7, the deposited pigments will be limited to a small amount, which can prevent clogging of the pressing spring 8 due to the deposited pigments and resulting defective movement of the valve body 6 from occurring. In use of the writing instrument 1, when the tapered surface 64 of the valve body 6 is released from the valve seat 91 in response to a pressure applied to the pen core 5 to open the ink supply passage 10, the flow area of the communication channel 11 is simultaneously increased to allow a necessary amount of ink to be adequately supplied from the ink chamber 2 to the pen core 5 through the communication channel 11 and the inner space of the support member 7.

Further, when the valve body 6 is in the close position, the contact region between the tapered surface 64 and the valve seat 91 is covered by the cover portion 63. Thus, even if the ink pigments are deposited in the inner space of the support member 7, the deposited ink pigments will be sufficiently restricted in entering into the contact region between tapered surface 64 and the valve seat 91. In addition, when the valve body 6 is moved to the open position, the deposited ink pigments are moved toward the rear end of the pen shaft 2 (toward the ink chamber 2) together with the cover portion 63. Thus, clogging of the pen core 5 is advantageously prevented.

In the above writing instrument 1, in conjunction with the movement of the pen core 5 toward the inside of the pen shaft 3 caused by a pressure applied thereto and the resulting movement of the valve body 6 from the close position to the open position, the cover portion 63 of the valve body 6 is spaced apart from the valve seat 91, and moved toward the ink chamber 2. In the course of the movement of the cover portion 63 toward the ink chamber 2, the ink in the inner space of the support member 7 is pushed out of the support member 7 into the ink chamber 2 while being stirred. Then, the ink pushed out into the ink chamber 2 by the cover portion 63 is additionally stirred in the ink chamber 2 by a stirring weight (not shown) provided in the ink chamber 2.

Thus, through the series of movements such that the valve body 6 is moved to the open position in response to the movement of the pen core 5 toward the inside of the pen shaft 3 caused by a pressure applied thereto, and the valve body 6 is returned to the close position by the pressing spring 8 after the release of the pressure, the following operations are performed: (1) stirring the ink in the inner space of the support member 7; (2) pushing out the ink in the inner space of the support member 7 into the ink chamber 2; and (3) isolating the ink chamber 2 from the inner space of the support member 7. The series of operations also make it possible to reduce the amount of ink pigments to be deposited in the inner space of the support member 7 and prevent occurrence of defects in the pressing spring 8 and the valve body 6.

The present invention is not limited to the construction of the above embodiment, but various modifications can be made. For example, while the above embodiment is constructed such that the taper surface 64 of the valve body 6 is brought into contact with the valve seat 91 to close the ink supply passage 10, and a small clearance is provided between the outer peripheral surface of the rear head 61 of the valve body 6 and the inner wall of the communication channel 11 when the valve body 6 is in the closed position, the flow area of the communication channel 11 in the closed position of the valve body 6 may be appropriately arranged according to characteristics of ink or the like to restrict the ink flow through the communication channel 11. For example, if ink has a relatively low viscosity, the communication channel 11 may be set up to be fully closed or approximately fully closed so as to restrict the ink flow. Conversely, if ink has a relatively high viscosity, the ink flow can be restricted regardless of the existence of some flow area.

Figure 5:
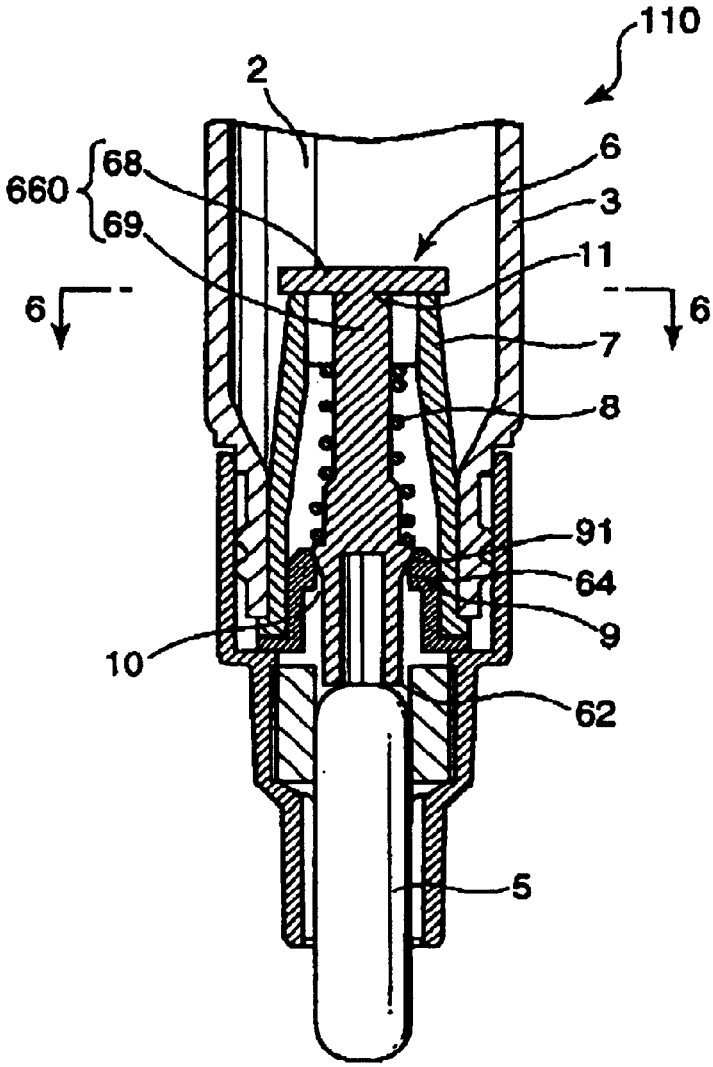
FIG. 5 is a fragmentary sectional view showing a structure around a pen core of a writing instrument according to another embodiment of the present invention, wherein a valve body is located at a position for closing an ink supply passage.
Figure 6:
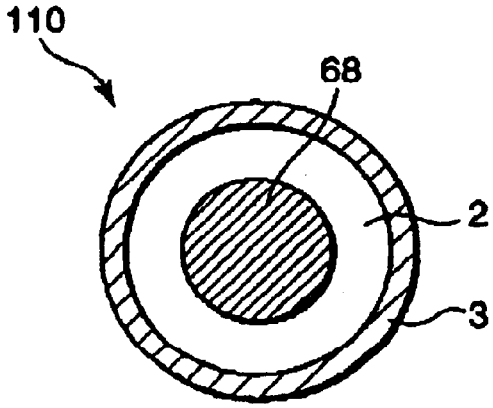
FIG. 6 is a sectional view taken along the line 6—6 in FIG. 5.
Figure 7:
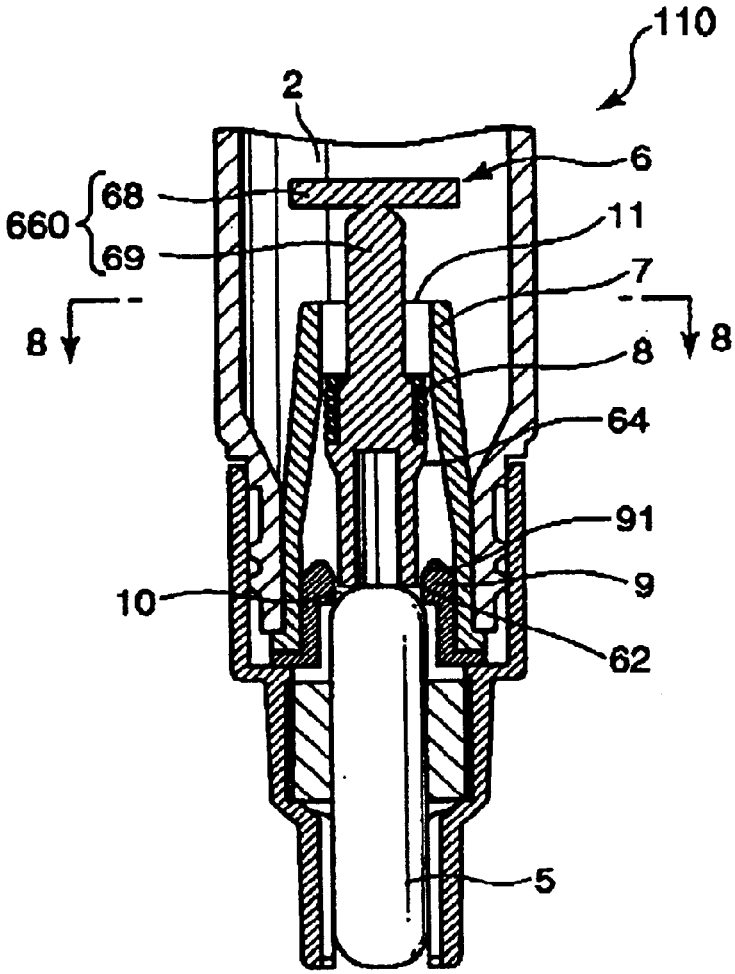
FIG. 7 is a fragmentary sectional view showing the writing instrument in FIG. 5, wherein the valve body is located at a position for opening both the ink supply passage and a communication channel.
Figure 8:
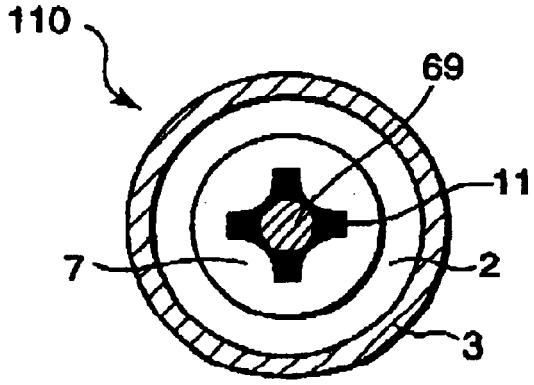
FIG. 8 is a sectional view taken along the line 8—8 in FIG. 7.

For example, the "channel control portion" herein is not limited to the configuration having a cross-sectional shape which is changed in the axial direction, but it may be a configuration in which a portion of the valve body 6 penetrating through the communication channel 11 and protruding into the ink chamber 2 includes a poppet-shaped closing head. FIG. 5 is a fragmentary sectional view showing the structure around a pen core of a writing instrument having such a channel control portion, wherein a valve body 6 is located at position for closing an ink supply passage 10. FIG. 6 is a sectional view taken along the line 6—6 in FIG. 5. FIG. 7 is a fragmentary sectional view showing the writing instrument, wherein the valve body 6 is located at a position for opening the ink supply passage 10. FIG. 8 is a sectional view taken along the line 8—8 in FIG. 7.

In this writing instrument 110, the end of the valve body 6 on the inward side of a pen shaft 3 (a portion of the valve body 6 penetrating through a communication channel 11 and protruding into an ink chamber 2) is formed as a poppet-shaped closing head 68, and a channel control portion 660 comprises the poppet-shaped closing head 68, and a shank 69 having an even diameter arranged without change in the axial direction. Other mechanisms of the writing instrument 110 for slidably moving the valve body 6 in the axial direction of the pen shaft 3 by use of the biasing force of a pressing spring 8 and a pressure applied to the pen core 5 toward the inside of the pen shaft 3, and allowing the valve body 6 to open and close the ink supply channel 10, based on the contact and release of the taper surface 64 of the valve body 6 relative to a valve seat 91 in conjunction with the above sliding movement, are the same as those in the aforementioned writing instrument 1.

In the writing instrument 110, when the valve body 6 is in the close position, the poppet-shaped closing head is operative to cover the communication channel 11 from the side of the ink chamber 2 and close the boundary between the ink chamber 2 and the inner space of the support member 7 so as to restrict the ink flow toward the inner space of the support member 7. Further, when the valve body 6 is moved to the open position in response to the movement of the pen core 5 toward the rear end of the pen shaft 3 (toward the inside of the pen shaft 3) caused by a pressure applied thereto, the poppet-shaped closing head 68 is spaced apart from the communication channel 11 to communicate the ink chamber 2 with the inner space of the support member 7, so that the ink in the ink chamber 2 flows into the inner space of the support member 7 through the clearance between the communication channel 11 and the valve body 6.

Figure 9:
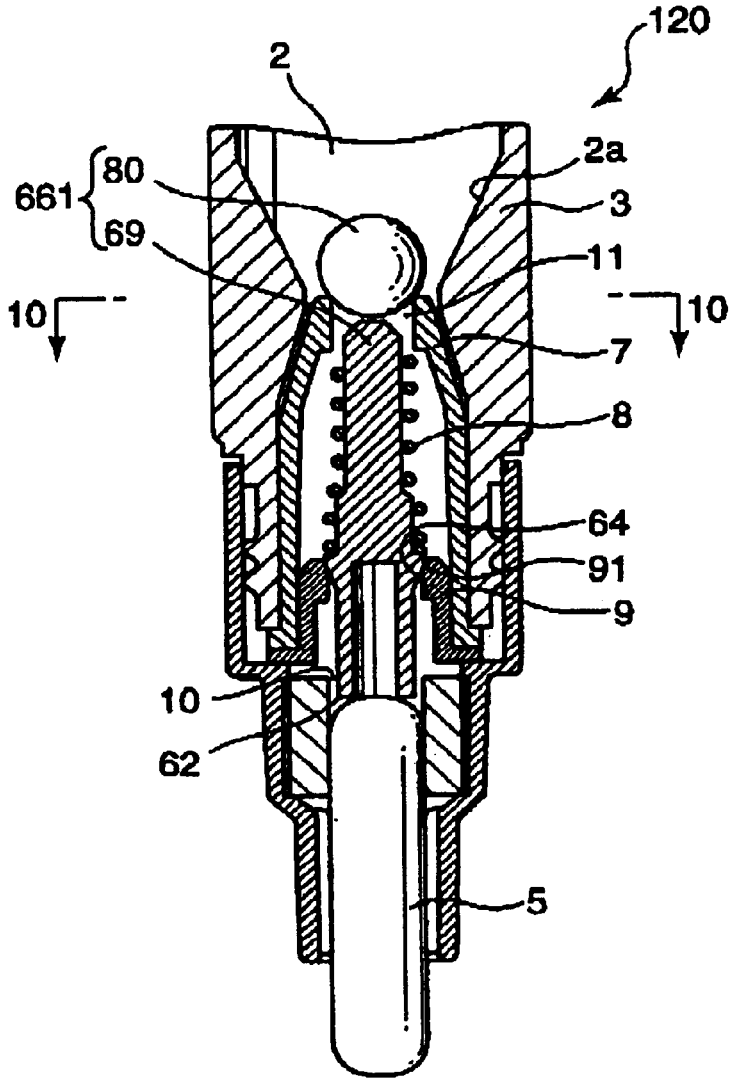
FIG. 9 is a fragmentary sectional view showing a structure around a pen core of a writing instrument according to still another embodiment of the present invention, wherein a valve body is located at a position for closing an ink supply passage.
Figure 10:
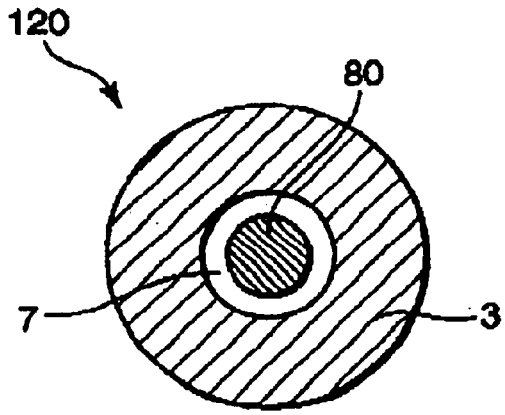
FIG. 10 is a sectional view taken along the line 10—10 in FIG. 9.
Figure 11:
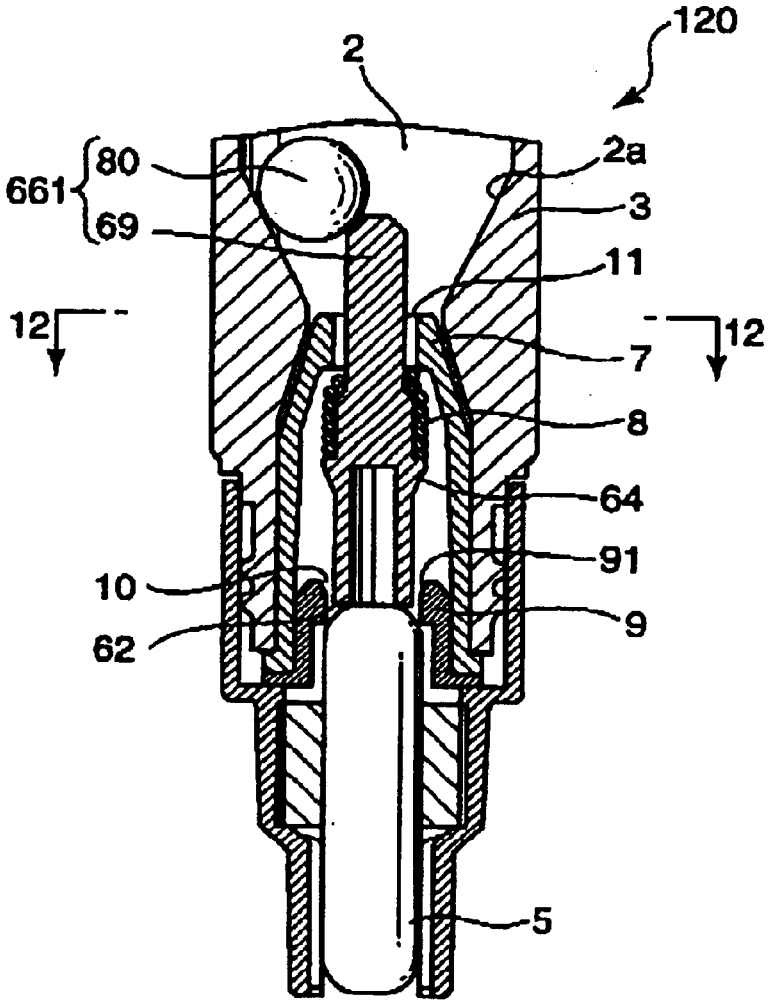
FIG. 11 is a fragmentary sectional view showing the writing instrument in FIG. 9, wherein the valve body is located at a position for opening both the ink supply passage and a communication channel.
Figure 12:
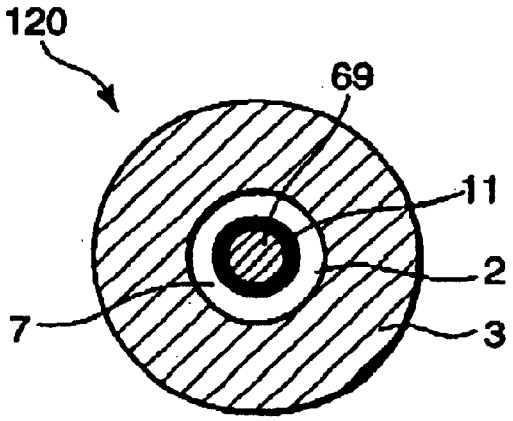
FIG. 12 is a sectional view taken along the line 12—12 in FIG. 11.
Figure 13:
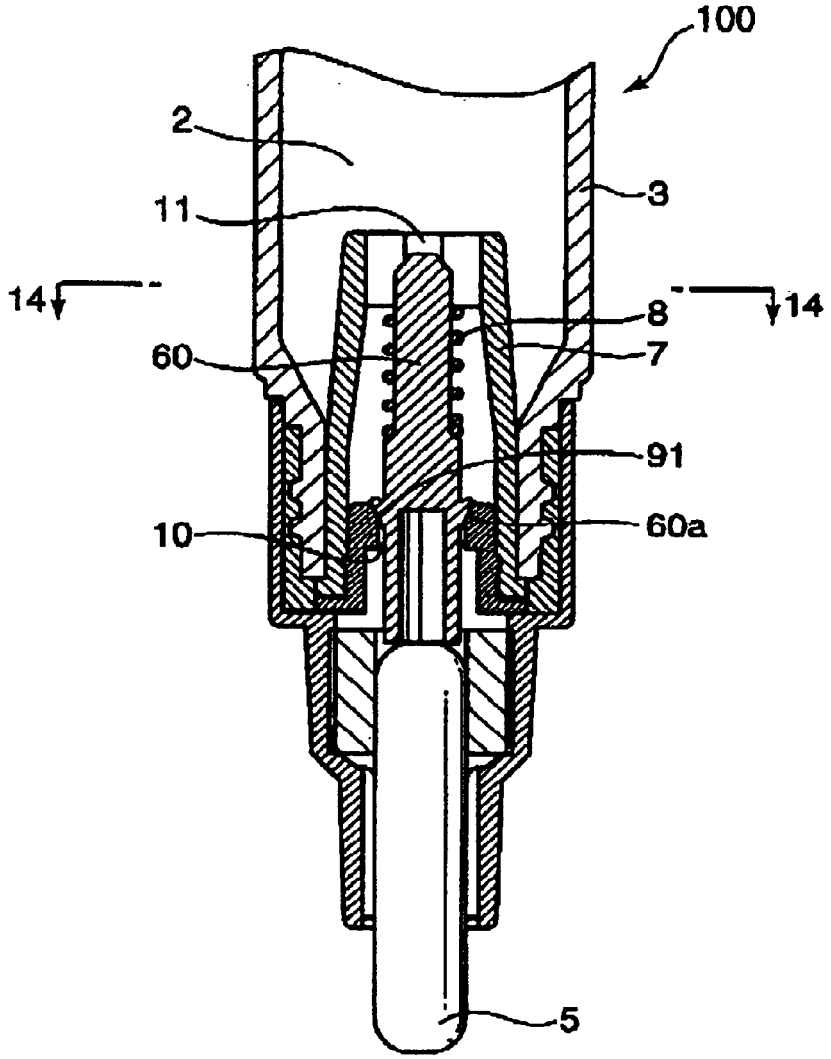
PRIOR ART FIG. 13
FIG. 13 is a fragmentary sectional view showing a structure around a pen core of a conventional writing instrument.
Figure 14:
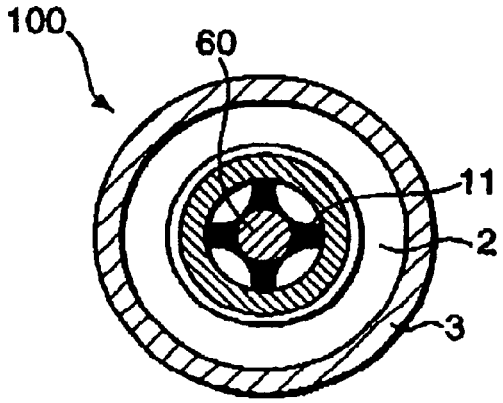
PRIOR ART FIG. 14
FIG. 14 is a sectional view taken along the line 14—14 in FIG. 13.

A writing instrument according to still another embodiment of the present invention will be described below. FIG. 9 is a fragmentary sectional view showing the structure around a pen core of this writing instrument, wherein a valve body 6 is located at a position for closing an ink supply passage 10. FIG. 10 is a sectional view taken along the line 10—10 in FIG. 9. FIG. 11 is a fragmentary sectional view showing the writing instrument, wherein the valve body 6 is located at a position for opening the ink supply passage 10. FIG. 12 is a sectional view taken along the line 12—12 in FIG. 11.

A channel control portion 661 in the writing instrument 120 according to this embodiment comprises a spherical cap member 80 provided in the ink chamber 2, and a shank 69 having an even diameter arranged without change in the axial direction. Other mechanisms of the writing instrument 120 for slidably moving the valve body 6 in the axial direction of a pen shaft 3 by use of the biasing force of a pressing spring 8 and a pressure applied to the pen core 5 toward the inside of the pen shaft 3, and allowing the valve body 6 to open and close the ink supply channel 10, based on the contact and release of the taper surface 64 of the valve body 6 relative to a valve seat 91 in conjunction with the above sliding movement, are the same as those in the aforementioned writing instrument 1.

As shown in FIG. 9, the cap member 80 has a larger diameter than that of the opening of the communication channel 11 to allow a part of the cap member 80 to be fitted or inserted into the communication channel 11. When the cap member 80 receives no pressure from the valve body 6, it is inserted into the communication channel 11 to close the communication channel 11. As shown in FIG. 11, when the cap member 80 receives a certain pressure in response to the sliding movement of the valve body 6, the cap member 80 is moved toward the inside of the ink chamber 2 by the pressure from the valve body and released from the communication chamber 11 to communicate the ink chamber 2 with the inner space of the support member 7.

In order to guide the cap member 80 to the communication channel 11, the inner wall 2*a* of the ink chamber 2 in the writing instrument 120 is formed in a configuration having an inclination toward the communication channel 11. Thus, as shown in FIG. 9, when the writing instrument 120 is in a posture where the pen core 5 is located on the lowest side thereof, the cap member 80 is guided to the communication channel 11 by the inner wall 2*a*, and the lower portion of the cap member 80 is fitted or inserted into the communication channel 11. The cap member 80 inserted into the communication channel 11 is interposed between the communication channel 11 and the ink chamber 2 to close the communication channel 11 so as to restrict the ink flow from the ink chamber 2 to the inner space of the support member 7. As shown in FIG. 9, the end of the valve body 6 on the side of the ink chamber 2 is configured such that it applies no pressure to or does not push the cap member inserted into the communication channel 11 when the valve body 6 is biased toward the pen core 5 by the pressure spring and kept in the close position. When the valve body 6 is moved toward the ink chamber 2 in response to the movement of the pen core 5 toward the inside of the pen shaft 3 caused by a pressure applied thereto, the cap member 80 is pushed toward the inside of the ink chamber 2 by the end of the valve body 6 on the side of the ink chamber 2, and released from the communication channel 11, as shown in FIG. 11. Thus, the ink in the ink chamber 2 flows into the inner space of the support member 7 through the clearance between the communication channel 11 and the valve body 6.

The spherical cap member 80 may also be used to provide a function as a stirring weight for stirring ink in the ink chamber 2. In this case, the need for providing the cap member in addition to a stirring weight can be eliminated to achieve a reduced manufacturing cost.

As mentioned above, according to the present invention, when the writing instrument is not used at other times, or the valve body is in the close position where it is in contact with the valve seat located between the ink chamber and the pen core, without pressure to be applied to the pen core, the valve body is operative to restrict the ink flow through the communication channel provided in the support member, so that the amount of ink flowing from the ink chamber into the inner space of the support member is reduced significantly (or to a large extent), and the amount of ink residing in the inner space of the support member is suppressed more than ever before. Thus, even if the pigments of ink is deposited in the inner space of the support member, the deposited pigments will be limited to a small amount, which can prevent malfunction in the biasing member due to the deposited pigments and resulting defective movement of the valve body from occurring. In use of the writing instrument, when the valve body is moved to the open position and released from the valve seat in response to a pressure applied to the pen core, the amount of ink flowing through the communication channel is simultaneously increased more than when the valve body is in the close position to allow ink to be adequately supplied from the ink chamber to the pen core through the communication channel and the inner space of the support member.

The configuration of the channel control portion may be arranged to allow a clearance between the inner peripheral surface of the communication channel and the outer peripheral surface of the channel control portion to be more reduced when the valve body is in the close position than when it is in the open position. In this case, the amount of ink flowing through the communication channel can be changed in response to the opening/closing operations of the ink supply passage only by contriving the configuration of the valve body.

The amount of ink flowing through the communication channel may be varied between when the valve body is in the open position and when it is in the close position by changing the cross-sectional shape of the channel control portion in the axial direction. In this case, the amount of ink flowing through the communication channel can be changed in response to the axial movement of the valve body.

The writing instrument may be arranged such that when the valve body is in the close position without pressure to be applied to the pen core, the channel control portion closes the communication channel. In this case, the ink flow from the ink chamber into the inner space of the support member is completely interrupted when the valve body is in the close position, and the amount of ink residing in the inner space of the support member is more suppressed. Thus, the ink pigments to be deposited in the inner space of the support member will be limited to an extremely small amount, which can more reliably prevent malfunction in the biasing member due to the deposited pigments and resulting defective movement of the valve body from occurring.

The valve body may be provided with a stirring portion protruding radially from the outer peripheral surface of the valve body to a position adjacent to the inner wall of the support member. In this case, as the stirring portion of the valve body is moved toward the ink chamber in conjunction with the movement of the valve body from the close position to the open position, the stirring portion is operative to push the ink in the inner space of the support member toward the ink chamber while stirring the ink. The ink pushed out into the ink chamber by the stirring portion may be additionally stirred in the ink chamber by use of a stirring weight or the like. Thus, through the series of movements such that the valve body is moved to the open position in response to a pressure applied to the pen core, and the valve body is returned to the close position by the biasing member after the release of the pressure, this writing instrument acts to (1) stir the ink in the inner space of the support member, (2) push out the ink in the inner space of the support member into the ink chamber, and (3) isolate the ink chamber from the inner space of the support member. The series of operations make it possible to reduce the amount of ink pigments to be deposited in the inner space of the support member and prevent occurrence of defects in the biasing member and the valve body due to the deposit of ink pigments in the inner space of the support member.

The stirring portion may be formed to cover the contact region between the valve body and the valve seat when the valve body is in the close position. In this case, even if the ink pigments are deposited in the inner space of the support member, the deposited ink pigments will be sufficiently restricted in entering into the contact region between the valve body and the valve seat.

Further, the writing instrument may be arranged such that the channel control portion comprises a poppet-shaped closing head at the end of the valve body on the inward side of the pen shaft, and a shank of the valve body, wherein the closing head is adapted to cover and close the communication channel from the side of the ink chamber when the valve body is in the close position, and to get away toward the rear end of the pen shaft so as to provide a clearance between the inner peripheral surface of the communication channel and the outer peripheral surface of the shank of the valve body when the valve body is in the open position. In this case, the communication channel can be reliably closed without matching respective dimensions of the closing head and the communication channel with a high degree of accuracy.

As described above, the occurrence of defect in the operation of the valve body due to the aforementioned deposit of ink pigments can be minimized by reducing the amount of ink to be stored in the inner space of the support member to restrain the amount of ink pigments to be deposited. Based on the above viewpoint, an inventive writing instrument is provided. The instrument is adapted, responsive to a pressure axially applied to a pen core, to supply ink stored in an ink chamber inside a pen shaft to the pen core through an ink supply passage. The writing instrument comprises a valve seat disposed between the ink chamber and the pen core, a valve body operable, responsive to a pressure applied to the pen core in the axial direction of the pen shaft and the release of the pressure, to be selectively moved between an open position where the valve body is spaced apart from the valve seat toward the rear end of the pen shaft to communicate the pen core with the ink chamber and a close position where the valve body is in contact with the valve seat to isolate the pen core from the ink chamber, biasing member for biasing the valve body toward the front end of the pen shaft to allow the valve body to be kept in the close position, and a support member disposed inside the ink chamber to surround the valve seat and at least a portion of the valve body to be brought into contact with the valve seat, while supporting the valve body and the biasing member to allow the valve body to be moved in the axial direction. In the writing instrument, the support member includes a communication channel for communicating the inner space of the support member with the ink chamber, and the valve body has a channel control portion for allowing the ink flow through the communication channel to be more restricted when the valve body is in the close position than when it is in the open position.

With this construction, when the writing instrument is not used at other times, or the valve body is in the close position where it is in contact with the valve seat located between the ink chamber and the pen core, without pressure to be applied to the pen core, the valve body is operative to restrict the ink flow through the communication channel provided in the support member, so that the amount of ink flowing from the ink chamber into the inner space of the support member is reduced, and the amount of ink residing in the inner space of the support member is suppressed more than ever before. Thus, even if the pigments of ink is deposited in the inner space of the support member, the deposited pigments will be limited to a small amount, which can prevent malfunction in the biasing member due to the deposited pigments and resulting defective movement of the valve body from occurring. In use of the writing instrument, when the valve body is moved to the open position and released from the valve seat in response to a pressure applied to the pen core, the amount of ink flowing through the communication channel is simultaneously increased more than when the valve body is in the close position to allow a necessary amount of ink to be adequately supplied from the ink chamber to the pen core through the communication channel and the inner space of the support member.

In the writing instrument, the channel control portion may be adapted to be inserted into the communication channel in the axial direction. In this case, the configuration of the channel control portion is arranged to allow a clearance between the inner peripheral surface of the communication channel and the outer peripheral surface of the channel control portion to be more reduced when the valve body is in the close position than when it is in the open position.

With this construction, the configuration of the channel control portion is arranged to allow a clearance between the inner peripheral surface of the communication channel and the outer peripheral surface of the channel control portion to be more reduced when the valve body is in the close position than when it is in the open position. Thus, the amount of ink flowing through the communication channel can be changed in response to the opening/closing operations of the ink supply passage only by contriving the configuration of the valve body.

In the above writing instrument, the configuration of the channel control portion may be changed in cross sectional in the axial direction.

The amount of ink flowing through the communication channel is varied between when the valve body is in the open position and when it is in the close position by changing the cross-sectional shape of the channel control portion in the axial direction. Thus, the amount of ink flowing through the communication channel can be changed in response to the axial movement of the valve body.

In the above writing instrument, the valve body may be adapted to close the communication channel by the channel control portion when the valve body is in the close position, and to provide a clearance between the inner peripheral surface of the communication channel and the outer peripheral surface of the channel control portion when the valve body is in the open position.

When the valve body is in the close position without pressure to be applied to the pen core, the channel control portion is operative to close the communication channel, so that the ink flow from the ink chamber into the inner space of the support member is completely interrupted, and the amount of ink residing in the inner space of the support member is more suppressed. Thus, the ink pigments to be deposited in the inner space of the support member will be limited to an extremely small amount, which can more reliably prevent malfunction in the biasing member due to the deposited pigments and resulting defective movement of the valve body from occurring.

In the above writing instrument, the valve body may be provided with a stirring portion protruding radially from the outer peripheral surface of the valve body to a position adjacent to the inner wall of the support member.

As the stirring portion of the valve body is moved toward the ink chamber in conjunction with the movement of the valve body from the close position to the open position, the stirring portion is operative to push the ink in the inner space of the support member toward the ink chamber while stirring the ink. The ink pushed out into the ink chamber by the stirring portion may be additionally stirred in the ink chamber by use of a stirring weight or the like. Thus, through the series of movements such that the valve body is moved to the open position in response to a pressure applied to the pen core, and the valve body is returned to the close position by the biasing member after the release of the pressure, the writing instrument having the stirring portion acts to (1) stir the ink in the inner space of the support member, (2) push out the ink in the inner space of the support member into the ink chamber, and (3) isolate the ink chamber from the inner space of the support member. The series of operations make it possible to reduce the amount of ink pigments to be deposited in the inner space of the support member and prevent occurrence of defects in the biasing member and the valve body due to the deposit of ink pigments in the inner space of the support member.

In this writing instrument, the stirring portion may be formed to cover the contact region between the valve body and the valve seat when the valve body is in the close position.

When the valve body is in the close position, the contact region between the valve body and the valve seat is covered by the stirring portion. Thus, even if the ink pigments are deposited in the inner space of the support member, the deposited ink pigments will be sufficiently restricted in entering into the contact region between the valve body and the valve seat.

In the writing instrument, the channel control portion may include a poppet-shaped closing head at the end of the valve body on the inward side of the pen shaft, and a shank of the valve body. In this case, the closing head is adapted to cover and close the communication channel from the side of the ink chamber when the valve body is in the close position, and to get away toward the rear end of the pen shaft so as to provide a clearance between the inner peripheral surface of the communication channel and the outer peripheral surface of the shank of the valve body when the valve body is in the open position.

When the valve body is in the close position, the poppet-shaped closing head is operative to cover and close the communication channel from the side of the ink chamber. Thus, the communication channel can be reliably closed without matching respective dimensions of the closing head and the communication channel with a high degree of accuracy.

This application is based upon and claims the benefit of priority from the prior Japanese Patent Application No. 2002-178290 filed on Jun. 19, 2002, the entire contents of which are incorporated herein by reference.

Advantageous embodiments of the present invention have been shown and described. It is obvious to those skilled in the art that various changes and modifications may be made therein without departing from the spirit and scope thereof as set forth in appended claims.

What is claimed is:

1. A writing instrument comprising:

a pen shaft having an ink chamber for storing ink;

a pen core provided in a leading end portion of the pen shaft, the pen core being movable in an axial direction of the pen shaft a valve seat disposed between the ink chamber and the pen core;

a valve body operable, responsive to a pressure applied to the pen core in the axial direction of the pen shaft and the release of the pressure, to be selectively moved between an open position where the valve body is spaced apart from the valve seat toward the rear end of the pen shaft to communicate the pen core with the ink chamber and a close position where the valve body is in contact with the valve seat to isolate the pen core from the ink chamber;

a biasing member for biasing the valve body toward the front end of the pen shaft to allow the valve body to be kept in the close position; and a support member disposed inside the ink chamber to surround the valve seat and at least a portion of the valve body to be brought into contact with the valve seat, the support member supporting the valve body and the biasing member to allow the valve body to be moved in an axial direction of the support member, wherein the support member includes a single communication channel for communicating the inner space of the support member with the ink chamber, the communication channel being formed in the support member along the axis of the support member, and the valve body has a channel control portion for allowing the ink flow through the communication channel to be more restricted when the valve body is in the close position than when it is in the open position.

2. A writing instrument comprising:

a pen shaft having an ink chamber for storing ink;

a pen core provided in a leading end portion of the pen shaft, the pen core being movable in an axial direction of the pen shaft a valve seat disposed between the ink chamber and the pen core;

a valve body operable, responsive to a pressure applied to the pen core in the axial direction of the pen shaft and the release of the pressure, to be selectively moved between an open position where the valve body is spaced apart from the valve seat toward the rear end of the pen shaft to communicate the pen core with the ink chamber and a close position where the valve body is in contact with the valve seat to isolate the pen core from the ink chamber;

a biasing member for biasing the valve body toward the front end of the pen shaft to allow the valve body to be kept in the close position; and a support member disposed inside the ink chamber to surround the valve seat and at least a portion of the valve body to be brought into contact with the valve seat, the support member supporting the valve body and the biasing member to allow the valve body to be moved in the axial direction, wherein the support member includes a communication channel for communicating the inner space with the ink chamber, and the valve body has a channel control portion for allowing the ink flow through the communication channel to be more restricted when the valve body is in the close position than when it is in the open position, wherein the channel control portion is adapted to be inserted into the communication channel in the axial direction, wherein the configuration of the channel control portion is arranged to allow a clearance between the inner peripheral surface of the communication channel and the outer peripheral surface of the channel control portion to be more reduced when the valve body is in the close position than when it is in the open position.

3. The writing instrument as defined in claim 2, wherein the valve body is adapted to close the communication channel by the channel control portion when the valve body is in the close position, and to provide a clearance between the inner peripheral surface of the communication channel and the outer peripheral surface of the channel control portion when the valve body is in the open position.

4. The writing instrument as defined in claim 2, wherein the valve body is provided with a stirring portion protruding radially from the outer peripheral surface of the valve body to a position adjacent to the inner wall of the support member.

5. The writing instrument as defined in claim 4, wherein the stirring portion covers the contact region between the valve body and the valve seat when the valve body is in the close position.

6. The writing instrument as defined in claim 2, wherein the cross sectional configuration of the channel control portion is changed in the axial direction.

7. The writing instrument as defined in claim 6, wherein the valve body is provided with a stirring portion protruding radially from the outer peripheral surface of the valve body to a position adjacent to the inner wall of the support member.

8. The writing instrument as defined in claim 7, wherein the stirring portion covers the contact region between the valve body and the valve seat when the valve body is in the close position.

9. The writing instrument as defined in claim 6, wherein the valve body is adapted to reduce the communication channel by the channel control portion when the valve body is in the close position, and to provide a clearance between the inner peripheral surface of the communication channel and the outer peripheral surface of the channel control portion when the valve body is in the open position.

10. The writing instrument as defined in claim 9, wherein the valve body is provided with a stirring portion protruding radially from the outer peripheral surface of the valve body to a position adjacent to the inner wall of the support member.

11. The writing instrument as defined in claim 10, wherein the stirring portion covers the contact region between the valve body and the valve seat when the valve body is in the close position.

12. A writing instrument comprising:

a pen shaft having an ink chamber for storing ink;

a pen core provided in a leading end portion of the pen shaft, the pen core being movable in an axial direction of the pen shaft a valve seat disposed between the ink chamber and the pen core;

a valve body operable, responsive to a pressure applied to the pen core in the axial direction of the pen shaft and the release of the pressure, to be selectively moved between an open position where the valve body is spaced apart from the valve seat toward the rear end of the pen shaft to communicate the pen core with the ink chamber and a close position where the valve body is in contact with the valve seat to isolate the pen core from the ink chamber;

a biasing member for biasing the valve body toward the front end of the pen shaft to allow the valve body to be kept in the close position; and a support member disposed inside the ink chamber to surround the valve seat and at least a portion of the valve body to be brought into contact with the valve seat, the support member supporting the valve body and the biasing member to allow the valve body to be moved in the axial direction, wherein the support member includes a communication channel for communicating the inner space with the ink chamber, and the valve body has a channel control portion for allowing the ink flow through the communication channel to be more restricted when the valve body is in the close position than when it is in the open position, wherein the channel control portion includes a poppet-shaped closing head at the end of the valve body on the inward side of the pen shaft, and a shank of the valve body, wherein the closing head is adapted to cover and close the communication channel from the side of the ink chamber when the valve body is in the close position, and to get away toward the rear end of the pen shaft so as to provide a clearance between the inner peripheral surface of the communication channel and the outer peripheral surface of the shank of the valve body when the valve body is in the open position.

13. A writing instrument comprising:

a pen shaft having an ink chamber for storing ink;

a pen core provided in a leading end portion of the pen shaft, the pen core being movable in an axial direction of the pen shaft a valve seat disposed between the ink chamber and the pen core;

a valve body operable, responsive to a pressure applied to the pen core in the axial direction of the pen shaft and the release of the pressure, to be selectively moved between an open position where the valve body is spaced apart from the valve seat toward the rear end of the pen shaft to communicate the pen core with the ink chamber and a close position where the valve body is in contact with the valve seat to isolate the pen core from the ink chamber;

a biasing member for biasing the valve body toward the front end of the pen shaft to allow the valve body to be kept in the close position; and a support member disposed inside the ink chamber to surround the valve seat and at least a portion of the valve body to be brought into contact with the valve seat, the support member supporting the valve body and the biasing member to allow the valve body to be moved in the axial direction, wherein the support member includes a communication channel for communicating the inner space with the ink chamber, and the valve body has a channel control portion for allowing the ink flow through the communication channel to be more restricted when the valve body is in the close position than when it is in the open position, wherein the valve body is adapted to close the communication channel by the channel control portion when the valve body is in the close position, and to provide a clearance between the inner peripheral surface of the communication channel and the outer peripheral surface of the channel control portion when the valve body is in the open position.

14. The writing instrument as defined in claim 1, wherein the valve body is provided with a stirring portion protruding radially from the outer peripheral surface of the valve body to a position adjacent to the inner wall of the support member.

15. The writing instrument as defined in claim 14, wherein the stirring portion covers the contact region between the valve body and the valve seat when the valve body is in the close position.

16. The writing instrument as defined in claim 1, wherein the channel control portion is adapted to be inserted into the communication channel in the axial direction of the support member, wherein the configuration of the channel control portion is arranged to allow a clearance between an inner peripheral surface of the communication channel and an outer peripheral surface of the channel control portion to be more reduced when the valve body is in the close position than when the valve body is in the open position.

17. The writing instrument as defined in claim 1, wherein the channel control portion includes a poppet-shaped closing head at the end of the valve body on the inward side of the pen shaft, and the valve body further including a shank, wherein the closing head is adapted to cover and close the communication channel from a side of the ink chamber when the valve body is in the close position, and to get away toward a rear end of the pen shaft so as to provide a clearance between an inner peripheral surface of the communication channel and an outer peripheral surface of the shank of the valve body when the valve body is in the open position.

18. The writing instrument as defined in claim 1, wherein the valve body is adapted to close the communication channel by the channel control portion when the valve body is in the close position, and to provide a clearance between an inner peripheral surface of the communication channel and an outer peripheral surface of the channel control portion when the valve body is in the open position.

* * * * *